US009673548B2

(12) United States Patent
Yudate

(10) Patent No.: US 9,673,548 B2
(45) Date of Patent: Jun. 6, 2017

(54) CONTACT CONNECTION STRUCTURE

(71) Applicant: YAZAKI CORPORATION, Tokyo (JP)

(72) Inventor: Takahiro Yudate, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/153,790

(22) Filed: May 13, 2016

(65) Prior Publication Data

US 2016/0336672 A1 Nov. 17, 2016

(30) Foreign Application Priority Data

May 14, 2015 (JP) ..... 2015-098770

(51) Int. Cl.
*H01R 13/115* (2006.01)

(52) U.S. Cl.
CPC ..... *H01R 13/115* (2013.01)

(58) Field of Classification Search
CPC ... H01R 13/111; H01R 13/113; H01R 13/115; H01R 13/11; H01R 13/187; H01R 13/20; H01R 13/04; H01R 13/15
USPC ..... 439/842–847, 850–853
See application file for complete search history.

(56) References Cited

U.S. PATENT DOCUMENTS 3,406,376 A * 10/1968 Varrin ..... H01R 13/111 439/852
3,679,934 A * 7/1972 Dukes ..... H01S 3/097 315/171
4,786,262 A * 11/1988 Molitor ..... H01R 13/187 439/843
5,651,705 A * 7/1997 Hsu ..... H01R 13/111 439/852
6,203,385 B1 * 3/2001 Sato ..... H01R 13/113 439/852
7,591,694 B2 * 9/2009 Osada ..... H01R 4/185 439/852
8,303,352 B2 * 11/2012 Hangartner ..... H01R 13/187 439/843

(Continued)

FOREIGN PATENT DOCUMENTS

JP 2002-289288 A 10/2002
JP 2014-241219 A 12/2014

OTHER PUBLICATIONS

The official action issued on Mar. 14, 2017 in the counterpart Japanese patent application.

*Primary Examiner* — Gary Paumen
(74) *Attorney, Agent, or Firm* — Mots Law, PLLC

(57) ABSTRACT

A contact connection structure includes a first terminal including a first contact portion including an indent and a second terminal including a second contact portion including a contact face that makes contact with the indent. The indent includes a first arc face having the first curvature center extending on a first line, the contact face includes a second arc face having a curvature different from the curvature of the first arc face, the second curvature center of the second arc face extending on a second line perpendicular to the first line. The first arc face and the second arc face make contact with each other by an elliptic region. The direction of one of the first line and the second line is the direction of the long axis of the elliptic region, and the direction of the other line is a direction of the short axis of the elliptic region.

8 Claims, 4 Drawing Sheets

(56) References Cited

U.S. PATENT DOCUMENTS

| | | | | |
|---|---|---|---|---|
| 2001/0051472 | A1* | 12/2001 | Sato | H01R 13/11 439/852 |
| 2003/0054701 | A1* | 3/2003 | Hutchinson | H01R 13/187 439/852 |
| 2008/0207009 | A1* | 8/2008 | Osada | H01R 4/185 439/34 |
| 2010/0304622 | A1* | 12/2010 | Shimazu | H01R 13/187 439/816 |

* cited by examiner

CONTACT CONNECTION STRUCTURE

CROSS REFERENCE TO RELATED APPLICATION

This application is based upon and claims the benefit of priority from the prior Japanese Patent Application No. 2015-098770, filed on May 14, 2015, the entire contents of which are incorporated herein by reference.

BACKGROUND

1. Technical Field

The present disclosure relates to a contact connection structure that makes electric connection between a first terminal and a second terminal.

2. Related Art

As a structure of making contact between two terminals, a structure having a spherical indent on a contact portion on either of the terminals has been proposed. JP 2014-241219 A discloses a female terminal that prevents the rise in resistance between contact portions caused by insulating particulates created by relative motions of terminals generated by, for example, vibration, being caught in the contact region between the contact portions.

SUMMARY

In the proposed technique, two terminals make contact with each other at an apex of the indent where insulating particulates are not likely to stay. Thus the technique is highly effective in preventing insulating particulates from being caught in the contact region between the contact portions. The contact area between two terminals however is inherently limited, so an idea is desired to reduce the contact resistance between two terminals as much as possible regardless of the existence of insulating particulates.

The present invention provides a contact connection structure that can reduce a contact resistance as much as possible even under a limited contact area between two terminals.

According to an aspect of the present invention, a contact connection structure includes a first terminal including a first contact portion including an indent, and a second terminal including a second contact portion including a contact face, the indent making contact with the contact face by the second contact portion being inserted in the first contact portion. The indent includes a first arc face projecting toward the contact face and having a first curvature center extending on a first line, the contact face includes a second arc face projecting toward the indent and having a curvature different from the curvature of the first arc face, a second curvature center of the second arc face extending on a second line perpendicular to the first line on which the first curvature center of the first arc face extends, and when the second contact portion is inserted in the first contact portion, the first arc face and the second arc face make contact with each other by an elliptic region, the direction of one of the first line and the second line being the direction of the long axis of the elliptic region, the direction of another one of the first line and the second line being the direction of a short axis of the elliptic region.

According to the structure described above, the first arc face of the indent provided on the first contact portion of the first terminal and the second arc face of the contact face of the second contact portion of the second terminal are arranged such that the curvature center of the first arc face and the curvature center of the second arc face extend on lines perpendicular to each other. The first arc face and the second arc face make contact with each other by an elliptic region of which long axis extends along one of the lines described above and short axis extends along the other line.

The contact resistance is smaller when the first arc face and the second arc face make contact with each other by an elliptic region than when contact is made by a contact region of a precise circle having the same contact area as the elliptic region, because the outer perimeter of the elliptic contact region is larger than the outer perimeter of the contact region of a precise circle. The structure is provided with an indent on the first contact portion of the first terminal, and thus the contact area between the indent and the contact face of the second contact portion of the second terminal is limited. Nevertheless, the contact resistance between the terminals can be kept as small as possible.

One of the long axis and the short axis may extend in an insertion direction in which the second contact portion is inserted in the first contact portion, and the other axis may extend in a direction perpendicular to the insertion direction.

According to the structure described above, one of the first arc face of the indent provided on the first contact portion and the second arc face of the contact face of the second contact portion is arranged such that the line on which the curvature center of the one of the arc faces exists extends along the direction in which the second contact portion is inserted in the first contact portion.

Therefore, the portion, of one of the arc faces, closest to the other arc face in the direction from the first arc face to the second arc face extends in the direction in which the second contact portion is inserted in the first contact portion. As a result, during insertion of the second contact portion in the first contact portion, the point on the other arc face, regarding the direction of the line in which the curvature center of the other arc face extends, that contacts the arc face is unchanged.

Therefore, the contact portion between the first arc face and the second arc face does not shift in a direction perpendicular to the direction in which the second contact portion is inserted in the first contact portion during the insertion of the second contact portion in the first contact portion. The second contact portion can thus be inserted in the first contact portion in a stable and smooth manner.

According to the structure described above, a contact resistance can be reduced as much as possible even under a limited contact area between two terminals.

DETAILED DESCRIPTION

Figure 1:
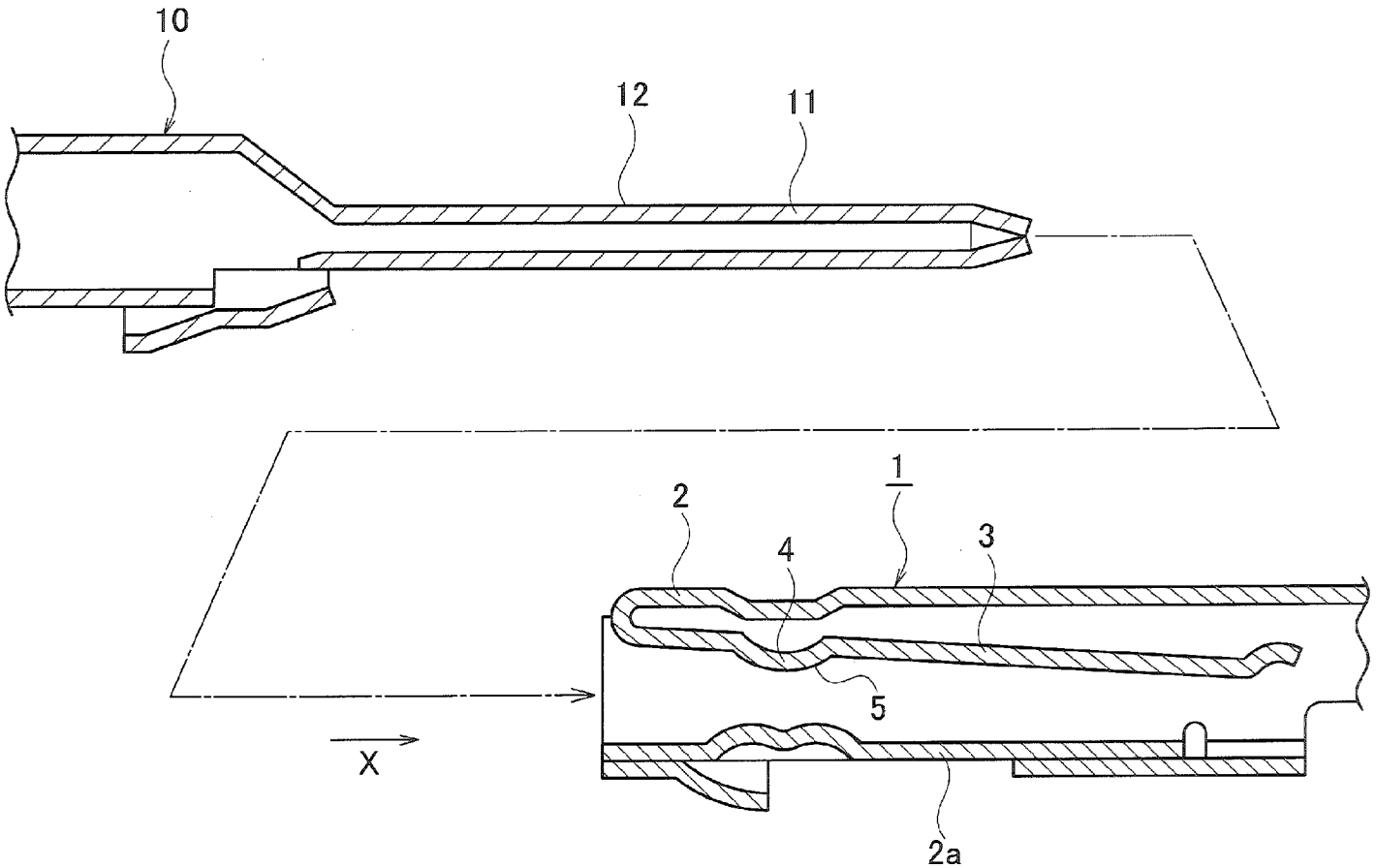
FIG. 1 is a sectional view of a female terminal and a male terminal, to which a contact connection structure according to an embodiment of the present invention is applied, not yet in a state of terminal connection.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Description will be hereinbelow provided for an embodiment of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from the actual ones.

An embodiment of the present invention will now be described referring to the drawings. FIG. 1 is a sectional view of a female terminal and a male terminal not yet in a state of terminal connection. A contact connection structure according to the embodiment is applied to a female terminal 1 (corresponding to a first terminal in the claims) and a male terminal 10 (corresponding to a second terminal in the claims) illustrated in FIG. 1.

The female terminal 1 is arranged in a terminal container in a female connector housing (not shown). The female terminal 1 is formed by bending a conductive metal (e.g., a copper alloy) punched out in a predetermined shape.

The female terminal 1 includes a box-section 2 which serves as a first contact portion. The box-section 2 has a squared shape with an opening in the forward side. A flexing portion 3 which continues from the top member of the box-section 2 via a bend is arranged inside the box-section 2. The flexing portion 3 is provided with an indent 4 projecting toward the bottom side. The indent 4 can move upward by a flexural deformation of the flexing portion 3. The flexing portion 3 and a bottom member 2*a* of the box-section 2 are arranged with a gap therebetween.

The male terminal 10 is arranged in a terminal container in a male connector housing (not shown). The male terminal 10 is formed by bending a conductive metal (e.g., a copper alloy) punched out in a predetermined shape.

The male terminal 10 includes a tab-section 11 which serves as a second contact portion. The tab-section 11 is a hollow protruding member. To couple together the female connector housing and the male connector housing, the tab-section 11 is inserted in a space between the flexing portion 3 of the female terminal 1 and the bottom member 2*a* of the box-section 2 in a direction indicated by an arrow X in FIG. 1.

Figure 2:
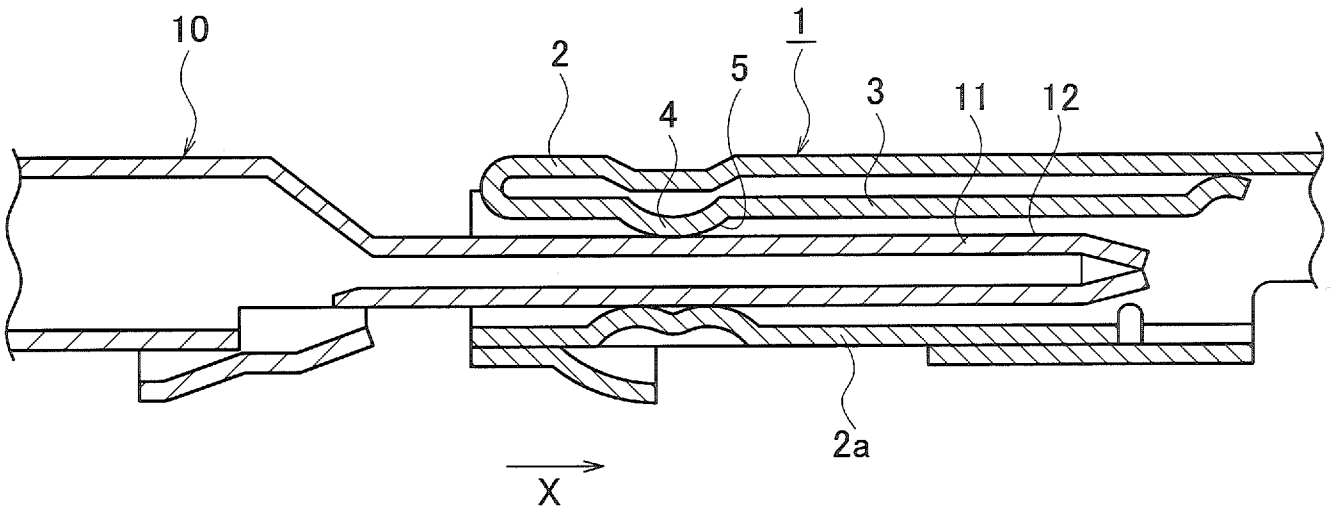
FIG. 2 is a sectional view of the female terminal and the male terminal illustrated in FIG. 1 in a state of terminal connection.

When coupling together the female connector housing and the male connector housing, the distal end of the tab-section 11 first contacts the flexing portion 3, and then advances further than this contact while the flexing portion 3 flexibly deforms to allow insertion of the tab-section 11. In the step of inserting the tab-section 11, the contact face 12 of the tab-section 11 slides, keeping contact with the indent 4, in the direction X in which the male terminal 10 is inserted in the female terminal 1, and then comes to the position of complete insertion of the terminal, as illustrated in FIG. 2.

The shape of the indent 4 of the female terminal 1 and the shape of the contact face 12 of the tab-section 11 of the male terminal 10 that contacts the indent 4 will now be described referring to FIGS. 3A, 3B, 4A, and 4B.

Figure 3A:
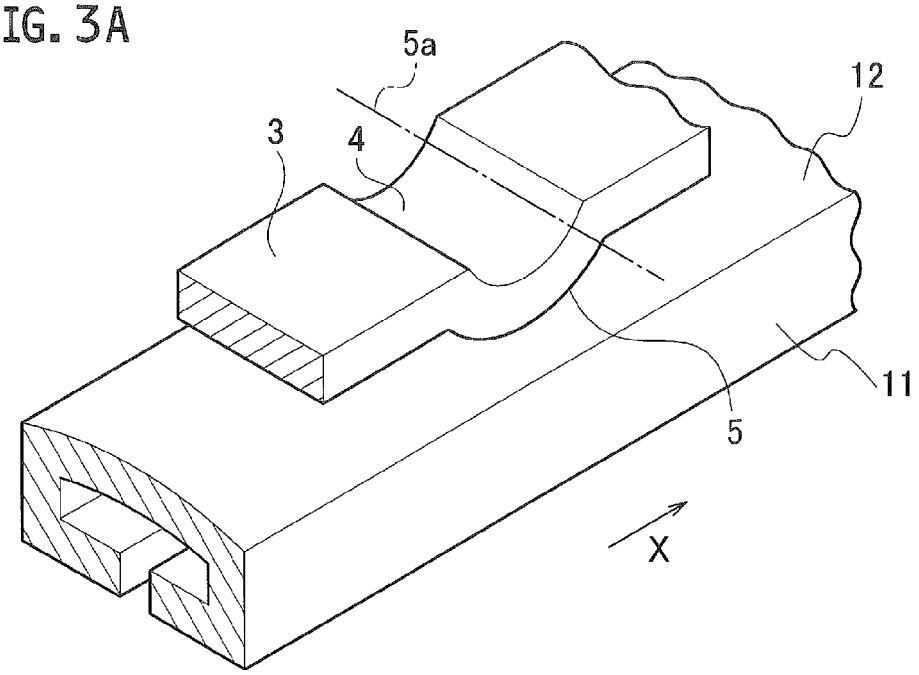
FIG. 3A is a perspective view schematically illustrating an essential portion of the contact connection structure according to an embodiment of the present invention, which is applied to contact portions of the female terminal and the male terminal illustrated in FIG. 1.
Figure 3B:
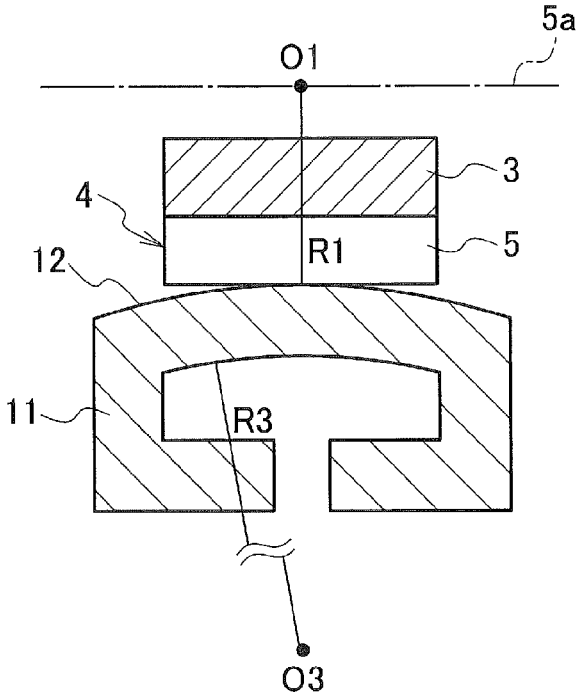
FIG. 3B is a sectional view schematically illustrating the contact connection structure according to an embodiment of the present invention, which is used in the contact portions of the female terminal and the male terminal illustrated in FIG. 1, viewed in a direction in which the male terminal is inserted in the female terminal.

As illustrated in FIG. 3A, the indent 4 includes an arc face 5 (corresponding to a first arc face in the claims) projecting toward the contact face 12 of the tab-section 11. As illustrated in FIGS. 3A and 3B, the curvature center of the arc face 5 (corresponding to a first curvature center in the claims) O1 extends on a line 5*a* perpendicular to the direction X, in which the male terminal 10 is inserted in the female terminal 1 (the line 5*a* corresponds to a first line in the claims).

The contact face 12 of the tab-section 11 (corresponding to a second arc face in the claims) has a form of an arc face projecting toward the indent 4. The curvature center of the contact face 12 illustrated in FIG. 3B (corresponding to a second curvature center in the claims) O3 extends on a line 12*a* parallel with the direction X, in which the male terminal 10 is inserted in the female terminal 1 (corresponding to a second line in the claims), as illustrated in FIG. 4A.

Figure 4A:
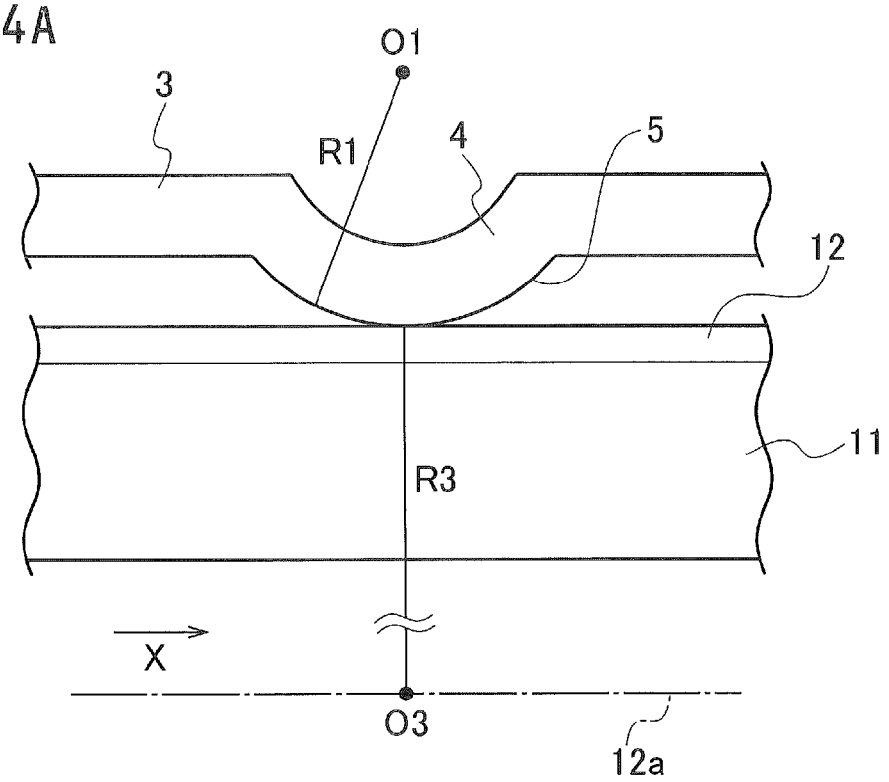
FIG. 4A is a side view schematically illustrating an essential portion of the contact connection structure according to an embodiment of the present invention, which is applied to the contact portions of the female terminal and the male terminal illustrated in FIG. 1.

As illustrated in FIGS. 3B and 4A, a curvature radius R1 of the arc face 5 is smaller than a curvature radius R3 of the contact face 12. That is, the arc face 5 has a smaller curvature than the contact face 12.

By inserting the tab-section 11 of the male terminal 10 configured as described above in the box-section 2 to push upward the flexing portion 3 of the female terminal 1, as illustrated in FIG. 2, the highest portion of the arc face 5 of the indent 4 projecting toward the tab-section 11 slides against the contact face 12 of the tab-section 11.

The contact between the arc face 5 of the indent 4 and the contact face 12 of the tab-section 11 is made only by the highest portions of the faces each projecting toward the opposing face. Therefore, insulating particulates that might be created by the contact face 12 of the tab-section 11 sliding against the arc face 5 of the indent 4 are not likely to be caught in the contact region between the arc face 5 and the contact face 12. Consequently, the rise in contact resistance between female terminal 1 and the male terminal 10 caused by the insulating particulates caught in the contact region is suppressed.

Figure 4B:
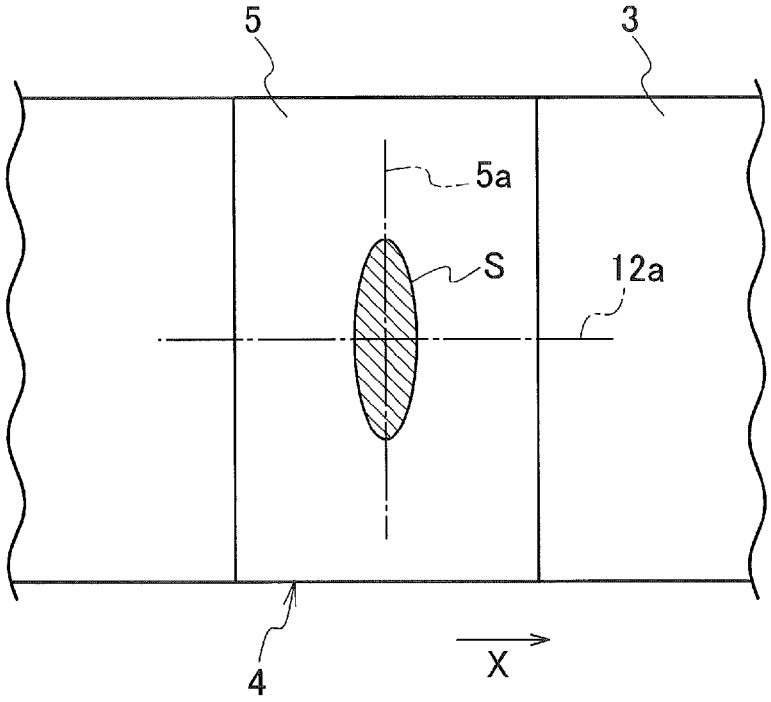
FIG. 4B is an explanatory view explaining an indent region that makes contact with a contact face of a tab-section in the contact connection structure according to an embodiment of the present invention, which is applied to the contact portions of the female terminal and the male terminal illustrated in FIG. 1.

Since both the arc face 5 of the indent 4 and contact face 12 of the tab-section 11 each has a curved surface, the contact face 12 of the tab-section 11 makes contact by a region S which is approximately in the center of the arc face 5 of the indent 4, as illustrated in diagonal lines in FIG. 4B. Since the arc face 5 of the indent 4 and the contact face 12 of the tab-section 11 have different curvatures and respectively have the curvature centers O1 and O3 existing on the lines 5*a* and 12*a* that are perpendicular to each other, the region S has an elliptic shape.

The region (elliptic region) S has the long axis extending along the line 5*a* on which the curvature center O1 of the arc face 5 extends, that is, along the direction perpendicular to the direction X, in which the male terminal 10 is inserted in the female terminal 1. The elliptic region S has the short axis extending along the line 12*a* on which the curvature center O3 of the contact face 12 extends, that is, along the direction X, in which the male terminal 10 is inserted in the female terminal 1.

The ratio of the long axis to the short axis, namely, the aspect ratio, of the region S is determined by the difference between the curvature of the arc face 5 of the indent 4 and the curvature of the contact face 12 of the tab-section 11.

The contact resistance is smaller when the arc face 5 of the indent 4 and the contact face 12 of the tab-section 11 make contact with each other by the elliptic region S than when contact is made by a contact region of a precise circle having the same contact area as the elliptic region S, because the outer perimeter of the elliptic region S is larger than the outer perimeter of the region of a precise circle.

For example, by setting the aspect ratio of the long axis to the short axis to 4:1, the contact resistance is reduced by 10%, in calculation, from the contact resistance of the contact between the arc face 5 of the indent 4 and the contact face 12 of the tab-section 11 made by a precise circular contact region. The contact resistance can be reduced by 40% by setting the aspect ratio to 25:1.

The structure is provided with the indent 4 on the flexing portion 3 of the box-section 2 of the female terminal 1 to prevent the rise in contact resistance caused by insulating particulates caught in the contact region, and therefore the contact area between the indent 4 and the contact face 12 of the tab-section 11 of the male terminal 10 is limited. Nevertheless, the contact resistance between the terminals can be kept as small as possible.

In the embodiment, the curvature center O3 of the contact face 12 of the tab-section 11 of the male terminal 10 extends on the line 12*a* parallel with the direction X, in which the male terminal 10 is inserted in the female terminal 1. Thus, while the tab-section 11 of the male terminal 10 is inserted in the box-section 2 of the female terminal 1, the contact face 12 of the tab-section 11 keeps contact at the same location, regarding the direction of the line 5*a* on which the curvature center O1 extends, of the arc face 5 of the indent 4 of the female terminal 1.

Therefore, the contact portion between the arc face 5 of the indent 4 and the contact face 12 of the tab-section 11 does not shift in a direction perpendicular to the direction X, in which the male terminal 10 is inserted in the female terminal 1, (the direction of the line 5*a*) during insertion of the tab-section 11 of the male terminal 10 in the box-section 2 of the female terminal 1. The male terminal 10 can thus be inserted in the female terminal 1 in a stable and smooth manner.

Instead of the line 12*a*, on which the curvature center O3 of the contact face 12 extends, the line 5*a*, on which the curvature center O1 of the arc face 5 extends, may be provided parallel with the direction X, in which the male terminal 10 is inserted in the female terminal 1. Instead of the line 5*a*, the line 12*a* may be provided perpendicular to the direction X, in which the male terminal 10 is inserted in the female terminal 1. Alternatively, the lines 5*a* and 12*a* may be provided perpendicular to each other but in arbitrary directions regardless of the direction X, in which the male terminal 10 is inserted in the female terminal 1.

The present invention is widely applicable to a contact connection structure for electrically connecting a first terminal and a second terminal by an indent provided on a first contact portion of the first terminal making contact with a contact face of a second contact portion of the second terminal.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. A contact connection structure comprising:

a first terminal including a first contact portion including an indent; and a second terminal including a second contact portion including a contact face, the indent making contact with the contact face by the second contact portion being inserted in the first contact portion, wherein the indent includes a first arc face projecting toward the contact face and having a first curvature center extending on a first line, the contact face includes a second arc face projecting toward the indent and having a curvature different from a curvature of the first arc face, a second curvature center of the second arc face extending on a second line perpendicular to the first line on which the first curvature center of the first arc face extends, when the second contact portion is inserted in the first contact portion, the first arc face and the second arc face make contact with each other by an elliptic region, a direction of one of the first line and the second line being a direction of a long axis of the elliptic region, a direction of another one of the first line and the second line being a direction of a short axis of the elliptic region, and a first curvature radius of the first arc face is smaller than a second curvature radius of the second arc face.

2. The contact connection structure according to claim 1, wherein one of the long axis and the short axis extends in an insertion direction in which the second contact portion is inserted in the first contact portion, and another one of the long axis and the short axis extends in a direction perpendicular to the insertion direction.

3. The contact connection structure according to claim 2, wherein in a condition in which an aspect ratio of the long axis to the short axis is set to a 4:1 ratio, a contact resistance of the elliptic region is reduced by 10%, compared to a condition in which the long axis and the short axis are the same and the contact between the first arc face and the second arc face is made in a circular contact region.

4. The contact connection structure according to claim 2, wherein in a condition in which an aspect ratio of the long axis to the short axis is set to a 25:1 ratio, a contact resistance of the elliptic region is reduced by 40%, compared to a condition in which the long axis and the short axis are the same and the contact between the first arc face and the second arc face is made in a circular contact region.

5. The contact connection structure according to claim 1, wherein the first terminal comprises a female terminal and the second terminal comprises a male terminal.

6. The contact connection structure according to claim 1, wherein the first contact portion of the first terminal comprises:

a box-section having a squared shape with an opening in a forward side thereof;

a flexing portion arranged inside the box-section, which continues from a top member of the box-section via a bend;

the indent is provided projecting from the flexing portion toward a bottom member of the box-section such that the indent is capable of moving upward by a flexural deformation of the flexing portion; and the flexing portion and the bottom member of the box-section are arranged with a gap therebetween.

7. The contact connection structure according to claim 6, wherein the second contact portion of the second terminal comprises:

a tab-section comprising a hollow protruding member, wherein the tab-section is inserted in a space between the flexing portion of the first contact portion of the first terminal and the bottom member of the box-section.

8. The contact connection structure according to claim 1, wherein contact between the first arc face and the second arc face is made only by highest portions of the first arc face and the second arc face such that insulating particulates created by sliding of the second arc face and the first arc face are not caught in the elliptical region and an increase in contact resistance between first terminal and the second terminal is suppressed.

* * * * *